US006655330B2

(12) United States Patent
Pierik

(10) Patent No.: US 6,655,330 B2
(45) Date of Patent: Dec. 2, 2003

(54) OFFSET VARIABLE VALVE ACTUATION MECHANISM

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 5 days.

(21) Appl. No.: 10/097,992

(22) Filed: Mar. 14, 2002

(65) Prior Publication Data

US 2003/0172887 A1 Sep. 18, 2003

(51) Int. Cl.[7] ..... F01L 1/34

(52) U.S. Cl. ..... 123/90.16; 123/90.15; 123/90.17; 123/90.31; 123/90.22

(58) Field of Search ..... 123/90.15–90.17, 123/90.22–90.25, 90.31, 90.39–90.45, 90.6

(56) References Cited

U.S. PATENT DOCUMENTS 5,988,125 A * 11/1999 Hara et al. ..... 123/90.16
6,386,161 B2 * 5/2002 Pierik ..... 123/90.16

OTHER PUBLICATIONS

VEL Article by Nissan, with translation (9 pages) Author: Unknown Date: Unknown.

* cited by examiner

*Primary Examiner*—Thomas Denion
*Assistant Examiner*—Kyle Riddle

(57) ABSTRACT

A variable valve actuation (VVA) mechanism includes an output cam having a first output cam lobe and a second output cam lobe. A body portion adjoins and axially separates the first and second output cam lobes. The body portion includes an outer surface. A portion of the outer surface is configured for being pivotally engaged by a cam support bearing.

23 Claims, 4 Drawing Sheets

OFFSET VARIABLE VALVE ACTUATION MECHANISM

TECHNICAL FIELD

The present invention relates to variable valve actuating mechanisms.

BACKGROUND OF THE INVENTION

Modern internal combustion engines may incorporate advanced throttle control systems, such as, for example, intake valve throttle control systems, to improve fuel economy and performance. Generally, intake valve throttle control systems control the flow of gas and air into and out of the engine cylinders by varying the timing and/or lift (i.e., the valve lift profile) of the cylinder valves in response to engine operating parameters, such as engine load, speed, and driver input. For example, the valve lift profile is varied from a relatively high-lift profile under high-load engine operating conditions to a reduced/lower low-lift profile under engine operating conditions of moderate and low loads.

Intake valve throttle control systems vary the valve lift profile through the use of variously-configured mechanical and/or electromechanical devices, collectively referred to hereinafter as variable valve actuation (VVA) mechanisms. Several examples of particular embodiments of VVA mechanisms are detailed in commonly-assigned U.S. Pat. No. 5,937,809, the disclosure of which is hereby incorporated herein by reference.

Generally, a conventional VVA mechanism includes a rocker arm that is displaced in a generally radial direction by an input cam of a rotating input shaft, such as the engine camshaft. A pair of link arms transfers the displacement of the rocker arm to pivotal oscillation of a pair of output cams relative to the input shaft or camshaft. Each of the output cams is associated with a respective valve. The pivotal oscillation of the output cams is transferred to actuation of the valves by cam followers, such as, for example, direct acting cam followers or roller finger followers.

A desired valve lift profile is obtained by orienting the output cams in a starting or base angular orientation relative to the cam followers and/or the central axis of the input shaft. The starting or base angular orientation of the output cams determines the portion of the lift profile thereof that engages the cam followers as the output cams are pivotally oscillated, and thereby determines the valve lift profile. The starting or base angular orientation of the output cams is set via a control shaft that pivots a pair of frame members and, via the rocker arm and link arms, pivots the output cams to a base angular orientation that corresponds to the desired valve lift profile.

A conventional VVA mechanism is typically disposed between and actuates a pair of functionally corresponding valves, such as, for example, a pair of intake valves, of an engine cylinder. Thus, the rocker arm, link arms, output cams, and frame members of the VVA mechanism must all be accommodated within the space between the corresponding valves. However, cam support bearings are also conventionally disposed between the valves of each cylinder. Locating the cam support bearings between the valves places the bearings more proximate to deflection forces imposed upon the camshaft that result from valve actuation, and thereby provides the camshaft with additional stiffness. Further, locating the cam support bearings between the valves enables the cylinder head bolts to be located more conveniently.

In order to accommodate VVA mechanisms, however, engine cylinder heads must typically be redesigned to relocate the cam support bearings. More particularly, the cam support bearings are typically relocated from between the valves of each cylinder to a position between the cylinders in order to accommodate the VVA mechanisms in the spaces between the valves. Similarly, the cylinder head bolts must also be relocated. Relocating the cam bearings reduces camshaft stiffness and thereby potentially results in undesirable deflection of the camshaft. Relocating the cylinder head bolts may also be problematic in that a less effective coupling of the cylinder head to the engine may result.

Therefore, what is needed in the art is a VVA mechanism that is configured for being installed between adjacent engine cylinders.

Furthermore, what is needed in the art is a VVA mechanism that is installed within an engine without requiring relocation of the cam support bearings.

Moreover, what is needed in the art is a VVA mechanism that is installed within an engine without requiring relocation of the cylinder head bolts.

SUMMARY OF THE INVENTION

The present invention provides a variable valve actuation mechanism that is configured for being disposed between adjacent engine cylinders, and thus does not require relocation of the cam support bearings or the cylinder head bolts.

The invention comprises, in one form thereof, an output cam having a first output cam lobe and a second output cam lobe. A body portion adjoins and axially separates the first and second output cam lobes. The body portion includes an outer surface. A portion of the outer surface is configured for being pivotally engaged by a cam support bearing.

An advantage of the present invention is that it is operably disposed between adjacent engine cylinders and thus does not require the cam support bearings to be relocated.

A further advantage of the present invention is that it does not require relocation by of the cylinder head bolts.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
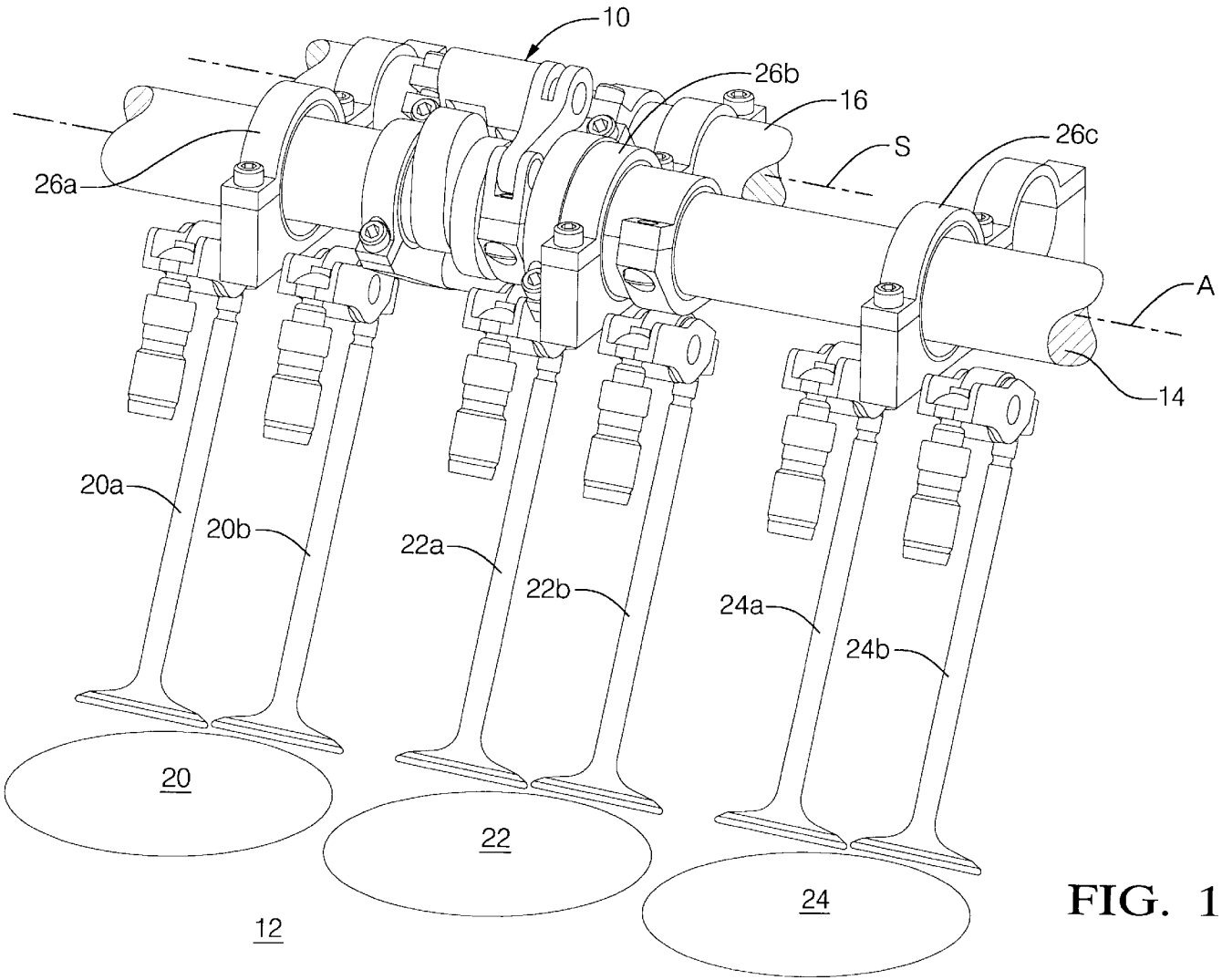
FIG. 1 is a perspective view of one embodiment of a variable valve actuation (VVA) mechanism of the present invention operably installed within an internal combustion engine.

Referring now to FIG. 1, there is shown one embodiment of a VVA of the present invention. Generally, VVA mechanism 10 is operably installed between adjacent cylinders of engine 12, thereby avoiding the need to relocate the cam support bearings and cylinder head bolts (not shown in FIG. 1) from the space between the valves of each cylinder in engine 12.

Engine 12 includes input shaft or camshaft 14 (hereinafter referred to as camshaft 14) having central axis A, control shaft 16 having central axis S, and cylinders 20, 22 and 24. Valves 20*a* and 20*b*, 22*a* and 22*b*, and 24*a* and 24*b*, are associated with cylinders 20, 22 and 24, respectively. Cam support bearing 26*a* is disposed between valves 20*a* and 20*b*, cam support bearing 26*b* is disposed between valves 22*a* and 22*b*, and cam support bearing 26*c* is disposed between valves 24*a* and 24*b*.

Figure 2:
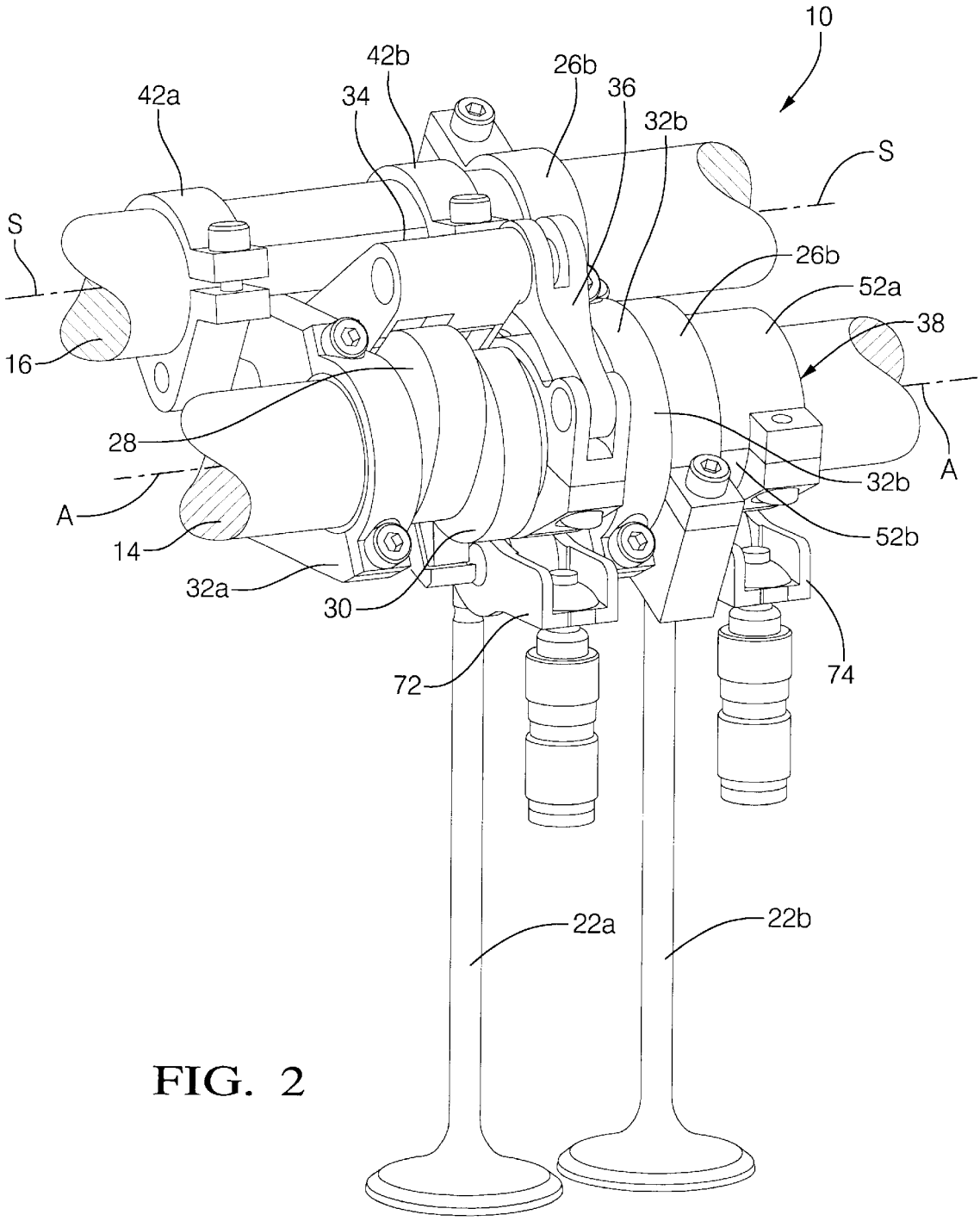
FIG. 2 is a perspective view of the VVA mechanism of FIG. 1.
Figure 3:
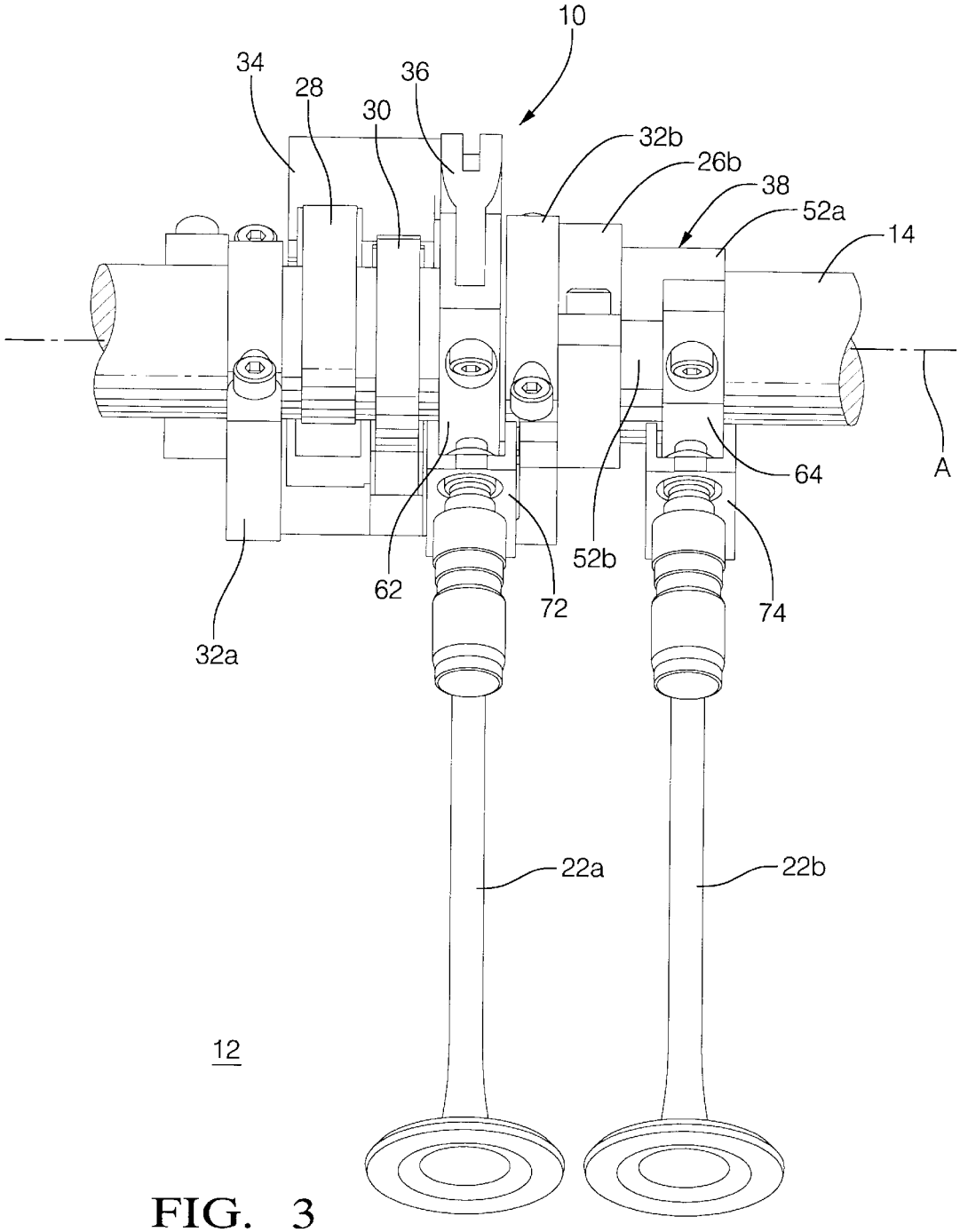
FIG. 3 is a front view of the VVA mechanism of FIG. 1.

Referring now to FIGS. 2 and 3, camshaft 14 is an elongate shaft member having input or opening cam lobe 28 and closing cam lobe 30. Input cam lobe 28 and closing cam lobe 30 are disposed between cylinders 20 and 22 of engine 12, and actuate valves 22*a*, 22*b* of cylinder 22 in a manner that will be more particularly described hereinafter. Opening cam lobe 28 and closing cam lobe 30 are disposed or paired in a predetermined angular relation relative to each other and relative to central axis A. Camshaft 14 is driven to rotate by, for example, a crankshaft (not shown) of engine 12. Input and closing cam lobes 28 and 30, respectively, rotate as substantially one body with camshaft 14. For the sake of clarity, only one pair of input and closing cam lobes 28 and 30 is shown. However, it should be understood that a respective input cam lobe 28, a respective closing cam lobe 30, and a respective VVA mechanism 10 are also provided for each of cylinders 20 and 24.

VVA mechanism 10, as is more particularly described hereinafter, is operably installed between cylinders 20 and 22, and actuates valves 22*a* and 22*b* of cylinder 22. VVA mechanism 10 includes frame members 32*a*, 32*b*, rocker arm 34, link arm 36 and output cam 38. For purposes of clarity, a single variable valve mechanism 10 is illustrated in the figures and discussed hereinafter.

Frame members 32*a* and 32*b* are configured as split or two-piece frame members. Generally, the pieces (not referenced) of each frame member 32*a*, 32*b*, are positioned on their respective and opposing sides or portions of camshaft 14 and then coupled together with the corresponding pieces by fasteners (not referenced), thereby pivotally coupling frame members 32*a* and 32*b* to camshaft 14. More particularly, frame member 32*a* is disposed on a first side of the paired input and closing cam lobes 28 and 30, respectively, and frame member 32*b* is disposed on a second side of paired input and closing cam lobes 28 and 30, respectively. Frame members 32*a* and 32*b* at respective first ends (not referenced) thereof are pivotally coupled by respective coupling means 42*a*, 42*b*, such as, for example, shaft clamps, to control shaft 16. Frame members 32*a* and 32*b* at respective second ends (not referenced) thereof are pivotally coupled, such as, for example, by pins, to a first end of rocker arm 34. Frame member 32*a* is thereby pivotally disposed upon camshaft 14, and frame member 32*b* is pivotally disposed upon output cam 38 as will be more particularly described hereinafter.

Thus coupled together and pivotally mounted, frame members 32*a*, 32*b* are not rotated by the rotation of camshaft 14. Rather, camshaft 14 is free to rotate about central axis A and relative to split frame members 32*a*, 32*b*, and frame members 32*a*, 32*b* are free to pivot relative to camshaft 14 and central axis A thereof.

Rocker arm 34, as is known in the art, carries one or more rollers or slider pads (not shown) that engage each of input and closing cam lobes 28 and 30. Rocker arm 34 is coupled, such as, for example, by pins, at a first end (not referenced) thereof to link arm 36 and at a second end (not referenced) thereof to each of frame members 32*a*, 32*b*.

Link arm 36 is an elongate arm member that is pivotally coupled, such as, for example, by pins, at a first end (not referenced) thereof to output cam 38 and at a second end (not referenced) thereof to rocker arm 34.

Figure 4:
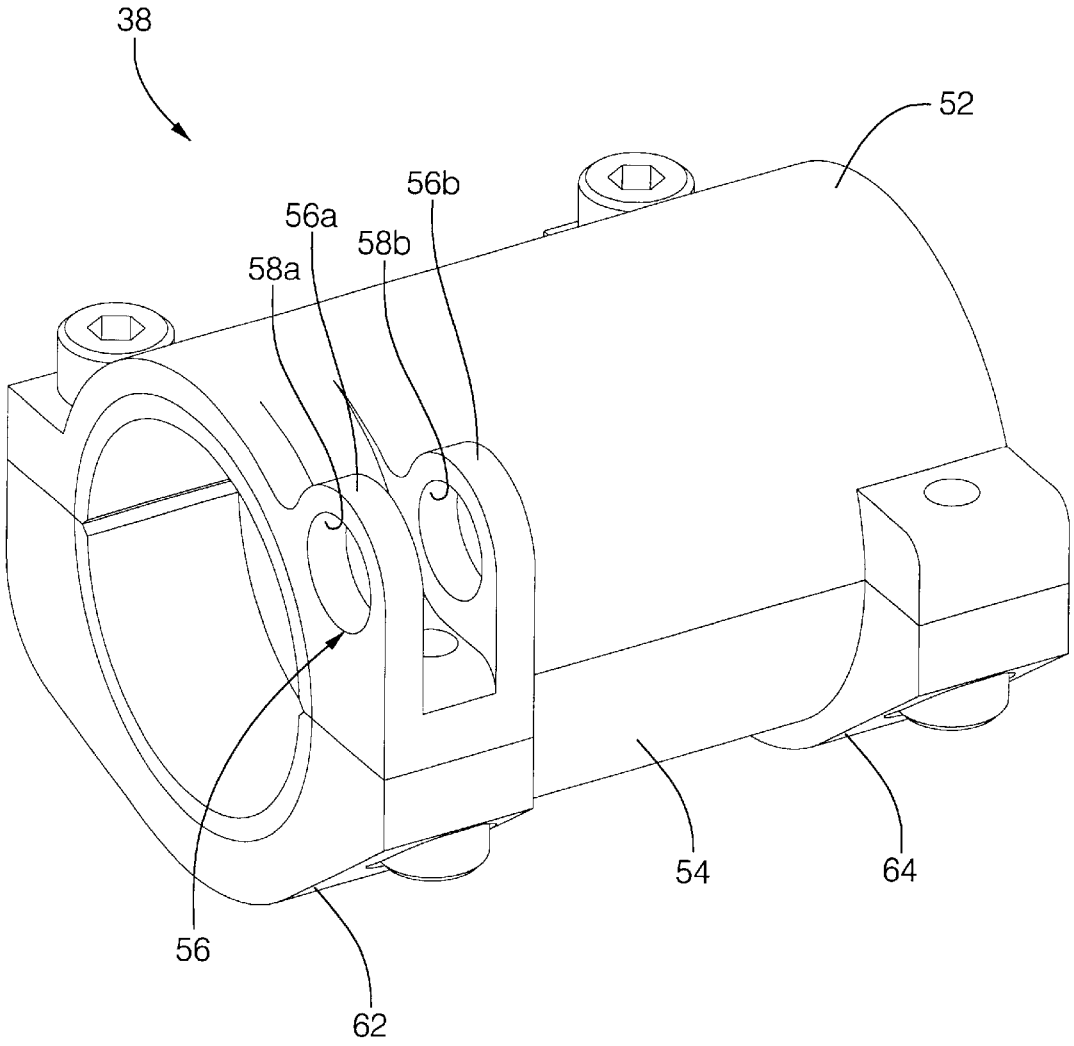
FIG. 4 is a perspective view of the output cam of FIG. 1.

Output cam 38 is pivotally disposed upon camshaft 14. More particularly, and as best shown in FIG. 4, output cam 38 is configured as a split or two-piece cam, and includes a first or top piece 52 and a second or bottom piece 54. Pieces 52 and 54 are elongate semi-cylindrical members each having a respective first and second end (not referenced) adjoining and spaced apart by body portion 52*a* and 52*b*, respectively. Pieces 52 and 54 are positioned on radially opposite sides or portions of camshaft 14 and then coupled together by fasteners (not referenced), to thereby pivotally dispose output cam 38 on camshaft 14.

First/top piece 52 at a first end thereof defines link-accepting feature 56 (FIG. 4) having opposing walls 56*a*, 56*b* that define substantially concentric bores 58*a*, 58*b*. The first end of link 36 is disposed between walls 56*a*, 56*b* such that an orifice (not shown) formed through link 36 is aligned with bores 58*a*, 58*b*. Output cam 38 is pivotally coupled to link 36 by coupling means, such as, for example, a pin, received within bores 58*a*, 58*b* and an orifice (not shown) in the first end of link 36. The first and second ends of first/top piece 52 include bores and flanges (not referenced) that enable first/top piece 52 and second/bottom piece 54 to be coupled together by fasteners, such as, for example, bolts, inserted through corresponding bores and flanges (not referenced) formed in second/bottom piece 54.

Second/bottom piece 54 defines dual cam lobes of output cam 38. More particularly, each of the first and second ends of second/bottom piece 54 includes a respective cam lobe surface or portion 62, 64 that is affixed to and/or integral with second/bottom piece 54. With output cam 38 pivotally disposed on camshaft 14, cam lobe portions 62, 64, are configured for engaging cam followers 72, 74 (FIGS. 2 and 3), respectively, to thereby actuate valves 22*a*, 22*b*, respectively.

It should be particularly noted that a portion of body portions 52*a* and 52*b* of output cam 38, when operably installed in engine 12, are disposed intermediate an inner surface (not referenced) of cam support bearing 26*b* and an outer surface (not referenced) of camshaft 14. More particularly, an inside surface (not referenced) of cam support bearing 26*b* engages a portion of the outer surface (not referenced) of body portions 52*a* and 52*b*. Output cam 38 is free to undergo pivotal movement relative to the inside surface of cam support bearing 26*b*. The inside surface of output cam 38 pivotally engages camshaft 14. Thus, cam support bearing 26*b* provides support to camshaft 14 via output cam 38. Body portions 52*a* and 52*b* of output cam 38 extend axially in both directions from the interface thereof with cam support bearing 26*b* and camshaft 14 such that cam lobe portions 62 and 64 are disposed on opposite sides of cam support bearing 26*b* and on opposite sides of input and closing cam lobe pair 28, 30.

It should further be particularly noted that frame member 32*b* is pivotally disposed upon body portions 52*a* and 52*b* of output cam 38, rather than being pivotally disposed upon camshaft 14 as in a conventional VVA. More particularly, the pieces (not referenced) of frame member 32*b* are positioned on their respective and opposing sides or portions of output cam body portions 52*a* and 52*b*, and then coupled together by fasteners (not referenced) to thereby pivotally coupling frame members 32*a* and 32*b* to output cam 38. Thus coupled together and pivotally disposed upon output cam 38, frame member 32*b* is not pivoted or rotated by the pivoting of output cam 38 nor by the rotation of camshaft 14. Rather, camshaft 14 and output cam 38 are free to rotate about central axis A and relative to split frame member 32*b*, and frame member 32*b* is free to pivot relative to camshaft 14, central axis A thereof, and output cam 38.

In use, VVA mechanism 10 operates in a generally similar manner as a conventional cam link variable valve actuating mechanism in regard to varying the lift profiles of the valves actuated thereby. Generally, a desired valve lift profile for associated valves 22*a*, 22*b* is obtained by placing control shaft 16 in a predetermined angular orientation relative to central axis S thereof, which, in turn, pivots output cam 38 relative to central axis A. Thus, the desired portion of the lift profiles of output cam lobe portions 62 and 64 are disposed within the pivotal oscillatory range of output cam 38 relative to cam followers 72, 74. As output cam 38 is pivotally oscillated, the desired portions of the lift profiles of output cam lobe 38 engage cam followers 72 and 74 to thereby actuate valves 22*a* and 22*b* according to the desired lift profile.

It should be particularly noted that output cam 38 actuates both valves 22*a* and 22*b*, which are disposed on opposite sides of cam support bearing 26*b*. As stated above, the first end of output cam 38 is pivotally coupled to link 36. As rocker arm 34 is displaced by the rotation of input cam 28, thereby pulling and/or pushing on link arm 36, the resultant torque causes the entire elongate output cam 38 to pivotally oscillate relative to central axis A. Each of cam lobe portions 62 and 64 pivot as substantially one body with output cam 38, and thus cam lobe portions 62 and 64 are also pivotally oscillated relative to central axis A. Cam lobe portions 62 and 64 are disposed on opposite sides of cam support bearing 26*b*, and actuate valves 22*a*, 22*b*, respectively, as output cam 38 is pivotally oscillated. Since link 36 is pivotally coupled to just one (i.e., the first) end of output cam 38, and since cam lobe portions 62 and 64 are disposed on opposite sides of cam support bearing 26*b*, VVA mechanism 10 is referred to as an offset VVA. Further, since VVA mechanism 10 is offset relative to cylinder 22, i.e., the cylinder with which it is operably associated, it is referred to as an offset VVA.

It should further be particularly noted that the outside surface (not referenced) of output cam body portions 52*a* and 52*b* are disposed between cam lobe portions 62 and 64. Body portions 52*a*, 52*b* are supported by cam bearings 26*b* in the cylinder head of engine 12, and thus provide support for camshaft 14. More particularly, the inner surfaces of each body portion 52*a* and 52*b* are in pivotal engagement with the outer surface of camshaft 14. At least a portion of the outer surface of body portions 52*a* and 52*b* are in pivotal engagement with the inside surface of cam support bearing 26*b*. Thus, camshaft 14 is provided with support and added stiffness by output cam 38, which, in turn, is supported by cam support bearing 26*b* and cam bearing 26*b* in the cylinder head of engine 12.

In the embodiment shown, VVA mechanism 10 is configured as a cam link and/or desmodromic variable valve actuation mechanism. However, it is to be understood that the VVA mechanism of the present invention can be alternately configured, such as, for example, as a non-desmodromic mechanism.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A variable valve actuation (VVA) mechanism, comprising:

an output cam including an elongate substantially semi-cylindrical top piece, said top piece having an inner surface and an outer surface, an elongate substantially semi-cylindrical bottom piece having an inner surface and an outer surface, first and second output cam lobes disposed on and axially separated by said outer surface of said bottom piece, a portion of each of said outer surfaces configured for being pivotally engaged by a cam support bearing, each respective said inner surface of said top and bottom pieces is configured for being disposed in engagement with radially-opposing portions of an outer surface of an input shaft, said top and bottom pieces configured for being coupled together to thereby pivotally dispose said output cam upon said input shaft.

2. The VVA mechanism of claim 1, wherein said top piece further includes a link-accepting feature for pivotally coupling said output cam to a link arm of said VVA mechanism.

3. The VVA mechanism of claim 1, wherein each of said top piece and said bottom piece include respective first and second ends, said first output cam lobe disposed proximate said first end of said bottom piece, said second output cam lobe disposed proximate said second end of said bottom piece.

4. The VVA mechanism of claim 1, further comprising a link arm pivotally coupled at a first end thereof to said output cam.

5. The VVA mechanism of claim 4, further comprising a rocker arm, a second end of said rocker arm pivotally coupled to a second end of said link arm.

6. The VVA mechanism of claim 5, further comprising at least one frame member pivotally disposed upon said outer surfaces of said output cam, a first end of said rocker arm pivotally coupled to said at least one frame member.

7. The VVA mechanism of claim 6, further comprising a control shaft pivotally coupled to said at least one frame member.

8. The VVA mechanism of claim 1, wherein said first output cam lobe and said second output cam lobe are integral and monolithic with said outer surface of said bottom piece.

9. An output cam for use with a variable valve actuating mechanism, comprising:

a body portion including an elongate substantially semi-cylindrical top piece, said top piece having an inner and an outer surface, an elongate substantially semi-cylindrical bottom piece having an inner and outer surface, each respective said inner surface of said top and bottom pieces is configured for being disposed in engagement with radially-opposing portions of an outer surface of an input shaft, said top and bottom pieces configured for being coupled together to thereby pivotally dispose said output cam upon said input shaft;

a first output cam lobe adjoining said body portion at a first end thereof; and a second output cam lobe adjoining said body portion at a second end thereof.

10. The output cam of claim 9, wherein said top piece further includes a link-accepting feature for pivotally coupling said output cam to a link arm of said VVA mechanism.

11. The output cam of claim 9, wherein each of said top piece and said bottom piece include respective first and second ends, said first output cam lobe disposed proximate said first end of said bottom piece, said second output cam lobe disposed proximate said second end of said bottom piece.

12. The output cam of claim 9, wherein said first output cam lobe and said second output cam lobe are integral and monolithic with said outer surface.

13. An internal combustion engine, comprising:

an elongate camshaft having a central axis, a plurality of cam lobes spaced axially apart along a length of said camshaft;

a plurality of cylinders, each of said cylinders being adjacent to at least one other of said cylinders relative to said central axis of said camshaft, a respective at least one of said cam lobes corresponding to each of said cylinders;

a respective pair of valves operably associated with each of said cylinders, each said pair of valves including a respective first and a respective second valve, said first valve being spaced a predetermined distance apart from said second valve relative to said central axis;

a respective cam support bearing disposed between each said first and second valve relative to said central axis, said cam support bearing coupled to said camshaft; and a respective variable valve actuation mechanism operably associated with each of said cylinders for transferring rotational movement of the corresponding said at least one of said cam lobes to actuation of the corresponding said pair of valves, said variable valve actuation mechanism pivotally coupled to said camshaft between the corresponding said first and second valve relative to said central axis, said variable valve actuation mechanism including an output cam having an outer surface, at least a portion of said outer surface being pivotally engaged by an inside surface of said cam support.

14. The internal combustion engine of claim 13, wherein each said variable valve mechanism further comprises:

a first output cam lobe disposed on said outer surface of said output cam, said first output cam lobe engaging a first cam follower associated with said first valve; and a second output cam lobe disposed on said outer surface of said output cam and axially spaced apart from said first output cam lobe, said second output cam lobe engaging a second cam follower associated with said second valve.

15. The internal combustion engine of claim 14, wherein each said output cam of said variable valve mechanism comprises:

an elongate substantially semi-cylindrical top piece, said top piece having an inner and an outer surface;

an elongate substantially semi-cylindrical bottom piece having an inner and outer surface, said outer surface including said first and second output cam lobes;

wherein each respective said inside surface of said top and bottom pieces is disposed in engagement with radially opposite portions of an outer surface of said camshaft, said top and bottom pieces being coupled together to thereby pivotally dispose said output cam upon said camshaft.

16. The internal combustion engine of claim 15, wherein said top piece of said output cam further includes a link-accepting feature, a link arm being received within said link-accepting feature to thereby pivotally couple said link to said output cam.

17. The internal combustion engine of claim 15, wherein each of said top piece and said bottom piece of said output cam include respective first and second ends, said first output cam lobe disposed proximate said first end of said bottom piece, said second output cam lobe disposed proximate said second end of said bottom piece.

18. The internal combustion engine of claim 15, wherein said variable valve actuation mechanism further comprises a link arm pivotally coupled at a first end thereof to said output cam.

19. The internal combustion engine of claim 18, wherein said variable valve actuation mechanism further comprises a rocker arm, a first end of said rocker arm pivotally coupled to a second end of said link arm.

20. The internal combustion engine of claim 19, wherein said variable valve actuation mechanism further comprises at least one frame member pivotally disposed upon the output cam, a second end of said rocker arm pivotally coupled to said at least one frame member.

21. The internal combustion engine of claim 20, further comprising a control shaft pivotally coupled to said at least one frame member.

22. The internal combustion engine of claim 15, wherein said first output cam lobe and said second output cam lobe are integral and monolithic with said bottom piece.

23. An internal combustion engine, comprising:

a variable valve actuation mechanism having an output cam, said output cam having an elongate substantially semi-cylindrical top piece, said top piece having an inner surface and an outer surface, an elongate substantially semi-cylindrical bottom piece having an inner surface and an outer surface, first and second output cam lobes disposed on and axially separated by said outer surface of said bottom piece;

a camshaft having an outside surface, said inner surfaces of said top and bottom pieces pivotally engaging radially opposed portions of said outside surface of said camshaft, said top and bottom pieces being coupled together to thereby pivotally dispose said output cam upon said camshaft; and a cam support bearing having an inside surface, said inside surface pivotally engaging said outer surfaces of said top and bottom pieces of said output cam to thereby support said camshaft.

* * * * *